United States Patent [19]

Wesenberg

[11] 4,090,323

[45] May 23, 1978

[54] MANNED TOY AIRCRAFT

[76] Inventor: Hans-Ulrich Wesenberg, Hammermuhlweg 6, D-8506 Langenzenn, Germany

[21] Appl. No.: 743,924

[22] Filed: Nov. 22, 1976

[30] Foreign Application Priority Data

Nov. 26, 1975 Germany ..... 2552976

[51] Int. Cl.[2] ..... A63H 33/20

[52] U.S. Cl. ..... 46/74 R; 46/86 R; 46/89

[58] Field of Search ..... 46/74 B, 86 R, 89

[56] References Cited

U.S. PATENT DOCUMENTS

| | | | |
|---|---|---|---|
| 1,291,991 | 1/1919 | Marui | 46/89 |
| 1,512,492 | 10/1924 | Segeberg | 46/86 R |

FOREIGN PATENT DOCUMENTS

| | | | |
|---|---|---|---|
| 1,071,879 | 3/1954 | France | 46/86 R |
| 2,257,235 | 11/1974 | Germany | 46/89 |

*Primary Examiner*—Louis G. Mancene
*Assistant Examiner*—Robert F. Cutting
*Attorney, Agent, or Firm*—Ross, Ross & Flavin

[57] ABSTRACT

A toy aircraft (in the form, for example, of a helicopter or aerial balloon) comprises a body above which is connected an air inflatable balloon whose mouthpiece nozzle is disposed with its axis pointing downwards through the center of gravity of the aircraft so that inflation of the balloon and subsequent release of the aircraft and the nozzle permits air to flow rapidly downwards as a jet and causes the aircraft to climb, is characterized in that a model person is separably connected to the body and is accommodated in a recess part of which is defined by a confronting surface of the balloon so that the balloon, when inflated retains the parachute in its recess, but upon deflation (e.g. when the aircraft has been driven to its maximum height, releases the parachute, so that the pilot becomes separated from the helicopter.

8 Claims, 11 Drawing Figures

MANNED TOY AIRCRAFT

This invention concerns a toy aircraft.

It has already been proposed to construct a toy aircraft with a body made of lightweight material, for example a plastics foam, and an inflatable air balloon. As a result of inflation of the air balloon, the toy aircraft can be caused to fly or climb. In such an aircraft, the usual mouthpiece nozzle of the air balloon is disposed so that its longitudinal axis extends through the centre of gravity of the aircraft, and the mouthpiece opening is directed downwards towards the ground in the normal flight attitude of the aircraft. The dimensioning of the aircraft components is such that the reaction arising from air, permitted to flow out of the mouthpiece opening of the inflated air balloon, is greater than the force of gravity acting on the aircraft. By reason of this design, after inflation of the balloon the aircraft is driven by the air flowing out of the balloon. The reaction force of the outflowing air decreases gradually and eventually diminishes to nothing with the emptying of the air balloon. From this moment onwards the aircraft can no longer climb, but on the contrary it returns to earth.

The speed of the return movement of the aircraft increases, of course, the nearer the aircraft gets to the ground. Therefore, the impression can arise that the aircraft is crashing. When such an impression arises, it is unreal in comparison with full-scale technology, because no survival measures are performed for the crew of the aircraft. The object of the invention is to remedy this by technical measures.

With this object in view, the present invention provides a toy manned aircraft, such as a helicopter, free balloon or the like, comprising an inflatable air balloon, a mouthpiece nozzle of which is disposed with its longitudinal axis extending through the centre of gravity of the aircraft and with its aperture directed downwards towards the ground in the normal flight attitude of the aircraft, the dimensioning of the aircraft being such that the reaction arising from air, permitted to flow from the mouthpiece opening of the inflated air balloon, is greater than the force of gravity acting on the toy aircraft, characterised in that at least one representation of a person is releasably connected to the aircraft and is equipped with an openable and foldable parachute, and in that the body of the aircraft has a support which faces towards the air balloon and has a bearing surface which, with the inflated air balloon, defines a reception space serving for accommodating the parachute in its folded condition, so that that portion of the air balloon which faces the support serves as an automatically closing and opening closure for the parachute space.

If, for example, the toy aircraft comprises an observation helicopter occupied by a model pilot, then as soon as the aircraft has reached its maximum height, the pilot will bail out of the aircraft and float to earth on the parachute, whilst the aircraft itself crashes to the ground. Departure from the helicopter by the pilot is effected automatically, because on the one hand the parachute is released and therefore glides away from the aircraft and because on the other hand, as a result of its falling movement, the parachute unfolds, so that the dropping speed of the parachutist (i.e. the pilot) is retarded, whilst the falling speed of the aircraft increases. As a result of this, the model of the pilot is disconnected from the aircraft, so that now the pilot, completely separated from the aircraft, floats slowly to the ground, while the latter returns crashwise to the ground.

The invention will be described further, by way of example, with reference to the accompanying drawings which illustrate two exemplified embodiments and in which.

Figure 1:
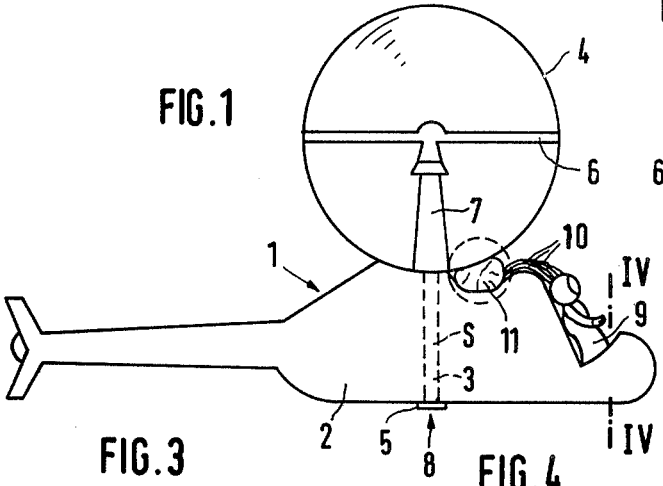
FIG. 1 is a diagrammatic side elevation of a first embodiment of the toy aircraft of the invention, which is in the form of a helicopter having a model pilot.
Figure 2:
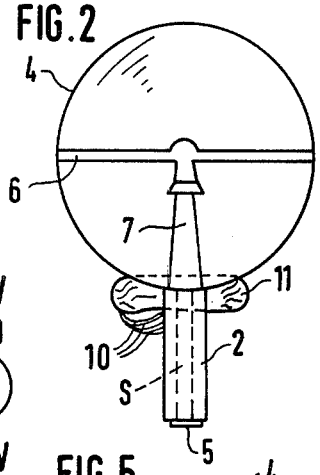
FIG. 2 is a front view of the toy aircraft of FIG. 1.
Figure 3:
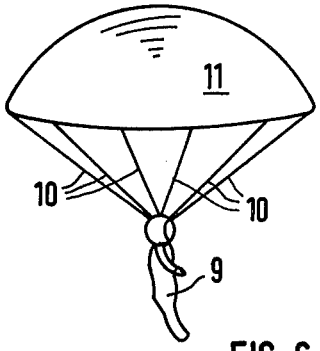
FIG. 3 is a side view illustrating the model pilot, from the aircraft of FIGS. 1 and 2, separated from the aircraft and floating to earth on a parachute.
Figure 4:
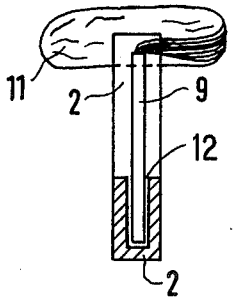
FIG. 4 is a section taken along the line IV—IV of FIG. 1.

The toy aircraft illustrated in FIG. 1, in the form of a helicopter 1, has a body 2 of lightweight material, more especially of plastics foam, for example of the plastics material known under the trade name "Styropor", through which is a bore which extends perpendicularly to the longitudinal axis of the helicopter and through which extends a mouthpiece nozzle 3 of an inflatable air balloon 4 of rubber or a rubber-like material. A bead 5 at the free end of the mouthpiece nozzle 3 butts against the underside of the body 2. The bore through the body 2 is so disposed that its longitudinal axis extends through the centre of gravity S, so that in the normal flight attitude of the helicopter 1, the bore extends substantially vertically downwards towards the ground. As can be seen more especially from FIG. 2, the body 2 is of slab-like form with its opposite side faces substantially parallel; the air balloon 4 is decorated with representations of rotor blades 6 and a rotor bearing 7.

Figure 5:
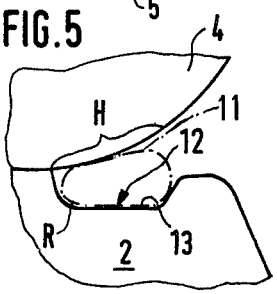
FIG. 5 is an enlarged fragmentary detail of the part indicated by a dotted circle in FIG. 1, the position of the parachute having been indicated in this figure using dot-dash lines.

A model of a helicopter pilot 9 is connected in a releasable manner to the body 2, and the pilot 9 is connected to a model parachute 11 by simulated parachute ropes 10. The parachute 11 is kept folded up, during launching and climbing of the helicopter 1, in a recess 12 which is provided in the body 2. This recess 12 faces upwards towards the air balloon 4 and its surfaces define a support chamber R for the folded-up parachute 11 lying therein. Base 13 of the recess 12 serves as bearing surface for the parachute 11. That portion H of the air balloon 4 which faces the open recess 12 serves to retain the folded parachute 11 in the space indicated by the R in FIG. 5 and acts as an automatically closing and opening closure for parachute support chamber R.

The dimensioning of the aircraft is such that the reaction force which arises when air flows out of the mouthpiece nozzle 3 of the inflated air balloon 4 is greater than the force of gravity which acts on the helicopter 1 together with the pilot 9, the parachute 11 and its ropes 10. Consequently, if the balloon 4 is inflated, and the helicopter is released, as soon as the aperture 8 of the inflated air balloon 4 is freed, the helicopter climbs upwards, the pilot 9 and the parachute 11 being entrained therewith. The parachute 11 hardly affects the climbing of the helicopter. The portion H of the air balloon 4 holds the parachute 11 captive in the recess 12 until the air in the air balloon 4 has nearly all flowed out and the balloon 4 has contracted to a relatively small size. Then the portion H, which acts as a closure, is automatically cleared from the recess. The moment of release of the parachute coincides approximately with the instant at which the helicopter 1 reaches its highest height and reverses its direction of movement to start falling. Upon the helicopter starting to move downwardly, the parachute 11 slides out of the trough 12 and unfolds, as a result of air resistance. Consequently, an upwardly-directed force is exerted on the model pilot 9, so that the latter is drawn out of recess 12, in the body 2, in which it is loosely accommodated. As soon as this occurs, the helicopter 1 and the pilot 9 fall completely independently of one another towards the ground. The pilot 9 floats comparatively slowly to earth, whereas the helicopter 1 falls crash-wise to the ground.

Figure 11:
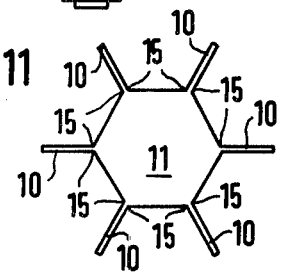
FIG. 11 is a plan view, to a reduced scale compared with FIGS. 1 to 4 and FIGS. 6 to 8, of a blank for forming the parachute.

The model person, namely the model pilot 9, is designed as a small slab of lightweight material of which the opposite sides are parallel. The parachute 11 is formed from an extremely thin plastics foil having, for example, a thickness of about 15 $\mu$. Constructionally, it has proved to be favourable to design the parachute 11 with a polygonal configuration, more especially as a hexagon, and to have the ropes 11 connecting with the corner points 15 of the polygon, as shown in FIG. 11. Furthermore, it is advantageous if the ropes 10 are in one piece with the parachute 11, because such ropes do not twist: the parachute opens completely and rapidly, which is very important when the helicopter rises only to a small height, for example when playing in a room.

Figure 6:
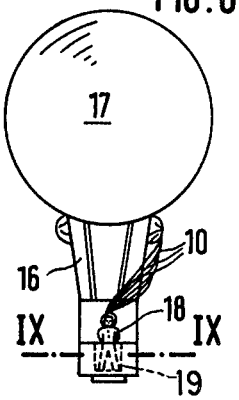
FIG. 6 is a front view of a second embodiment of the toy aircraft of the invention, this embodiment being in the form of a manned aerial-balloon.
Figure 7:
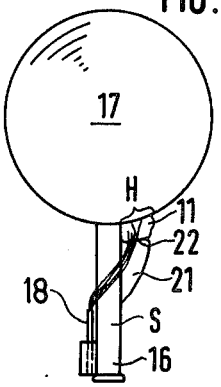
FIG. 7 is a side view corresponding to FIG. 6.
Figure 8:
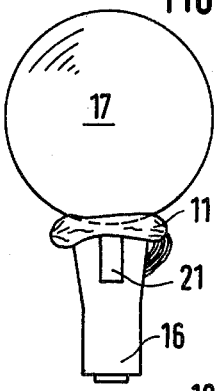
FIG. 8 is a rear view of the aerial balloon of FIGS. 6 and 7.

The aircraft embodiment of FIGS. 6 to 8 is in the form of an aerial balloon comprising a body 16 and an inflatable air balloon 17 of which the mouthpiece nozzle (not shown) extends through a bore in the body 16. As with the embodiment of FIGS. 1 to 5, this bore is so arranged that its longitudinal axis, and the longitudinal axis of the mouthpiece nozzle of the balloon 17 therethrough, extends through the centre of gravity S of the entire system. The body 16 is formed from a slab whose side surfaces are parallel and on which a gondola, with appropriate support ropes, is represented.

Figure 9:
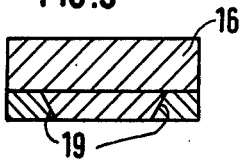
FIG. 9 is an enlarged section taken along the line IX—IX of FIG. 6.
Figure 10:
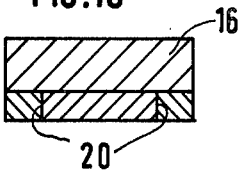
FIG. 10 is an enlarged section, similar to FIG. 9, but illustrating a modification.

The aerial balloon is fitted with a model balloon pilot 18, which is connected in a releasable manner to the body 16 via a dovetail guide 19 (FIG. 9) or a flat-rail guide 20 (FIG. 10). The dovetail guide 19 ensures a particularly reliable holding of the model balloon pilot 18, but it is relatively difficult to provide. Tests have shown, however, that also a flat-rail guide 20 as shown in FIG. 10 can suffice for holding the model balloon pilot 18 in place.

The model balloonist 18 is connected to its parachute 11 via parachute ropes or lines 10.

To hold the parachute 11 in its folded-up state, a hump or protuberance is provided on the body 16 which hump or protuberance 21 projects rearwardly. This hump 21 forms a support, whose top side 22, serving as bearing surface, is at a small distance from the confronting surfaces H of the air balloon 17 when the latter is in its inflated condition. Consequently the portion H of the inflated air balloon 17 and the top side 22 of the hump 21 define a recess or space in which the folded-up parachute 11 is accommodated. The balloon portion H accordingly forms, a closure which automatically retains the parachute 11 when the balloon is inflated, but which automatically releases the parachute 11 when the balloon has become empty.

I claim:

1. A manned toy aircraft, of which a helicopter and a free balloon are examples, comprising a body carrying an inflatable air balloon having a mouthpiece nozzle which is disposed with its longitudinal axis extending through the centre of gravity of the aircraft and has its aperture directed downwards towards the ground in the normal flight attitude of the aircraft, and of which the dimensioning is selected such that reaction force arising from air flowing out of the mouthpiece nozzle of the inflated air balloon is greater than the force of gravity which acts on the aircraft, characterised in that at least one model person is connected releasably to the aircraft and is equipped with an openable and foldable parachute and in that the body of the aircraft has a support which faces the air balloon and has a bearing surface which, with the inflated air balloon, defines a space for accommodating the folded-up parachute, that portion of the air balloon which faces the support serving as an automatically closing and opening closure for the said space for accommodating the parachute.

2. A toy aircraft as set forth in claim 1, characterised in that the said body is formed with an upwardly-open recess in which the model person is loosely accommodated.

3. A toy aircraft as set forth in claim 2, characterised in that a sliding guide is provided between the model person and the body of the aircraft.

4. A toy aircraft as set forth in claim 1, characterised in that the support is formed directly by the body of the aircraft, by means of an upwardly-open recess provided in said body.

5. A toy aircraft as set forth in claim 1, characterised in that the support is formed by means of a hump projecting from the body of the aircraft.

6. A toy aircraft as set forth in claim 1, characterised in that the parachute is of extremely thin plastics foil having, for example, a thickness of about 15 $\mu$.

7. A toy aircraft as set forth in claim 1, characterised in that ropes of the parachute are in one piece with the parachute.

8. A toy aircraft as set forth in claims 1 characterised in that the parachute is designed as a polygon, more especially a hexagon, and in that the ropes connect with respective corner points of the polygon.

* * * * *